US009073021B2

(12) United States Patent
Nakamura et al.

(10) Patent No.: US 9,073,021 B2
(45) Date of Patent: Jul. 7, 2015

(54) DEVICE AND METHOD FOR AUTOMATICALLY PREPARING EMULSION DRUG

(75) Inventors: Yusuke Nakamura, Tokyo (JP); Yuichi Iwai, Tokyo (JP); Kouji Yoshida, Kanagawa (JP)

(73) Assignees: ONCOTHERAPY SCIENCE, INC. (JP); THE UNIVERSITY OF TOKYO (JP)

( * ) Notice: Subject to any disclaimer, the term of this patent is extended or adjusted under 35 U.S.C. 154(b) by 1127 days.

(21) Appl. No.: 13/062,501

(22) PCT Filed: Sep. 7, 2009

(86) PCT No.: PCT/JP2009/065972

§ 371 (c)(1), (2), (4) Date: Mar. 4, 2011

(87) PCT Pub. No.: WO2010/027107

PCT Pub. Date: Mar. 11, 2010

(65) Prior Publication Data

US 2011/0160700 A1 Jun. 30, 2011

(30) Foreign Application Priority Data

Sep. 5, 2008 (JP) ..... 2008-229142

(51) Int. Cl.
*B01F 5/06* (2006.01)
*B01F 5/00* (2006.01)
(Continued)

(52) U.S. Cl.
CPC ..... *B01F 3/0807* (2013.01); *A61G 2203/34* (2013.01); *A61J 1/20* (2013.01); *A61J 3/00* (2013.01); *B01F 5/0685* (2013.01); *B01F 11/0071* (2013.01)

(58) Field of Classification Search
CPC .. B01F 5/0685; B01F 13/002; B01F 15/0278; B01F 15/00201; B01F 15/0237; B01F 3/0807; B01F 11/0071; A61J 1/2089; A61J 1/20; A61J 3/00; A61G 2203/34
USPC ..... 366/176.3, 332, 130, 181.1, 190
See application file for complete search history.

(56) References Cited

U.S. PATENT DOCUMENTS 1,288,966 A * 12/1918 Nielsen ..... 417/265
3,035,820 A * 5/1962 Todd et al. ..... 366/268
(Continued)

FOREIGN PATENT DOCUMENTS

JP 49-70562 6/1974
JP 2-14595 A 1/1990
(Continued)

OTHER PUBLICATIONS

International Preliminary Report on Patentability for PCT/JP2009/065972, Apr. 21, 2011, 7 pages.

*Primary Examiner* — Tony G Soohoo
(74) *Attorney, Agent, or Firm* — Hahn Loeser & Parks LLP

(57) ABSTRACT

In preparation of an emulsion by causing a mixture to flow from one syringe through a connector into another syringe, an object is to prevent the air from being entrained into cylinders and prepare the emulsion containing no air bubble, and another object is to easily prepare a homogeneous emulsion. Provided is a syringe pressing apparatus, including: a syringe fixing mechanism for fixing two syringes to a casing, the two syringes being coupled to each other through a connector; a pressing mechanism for alternately pressing syringe plungers of the two syringes; and a plunger-pressure-measuring device for measuring a pressure with which the pressing mechanism presses the syringe plungers.

23 Claims, 12 Drawing Sheets

(51) Int. Cl.

| | |
|---|---|
| ***B01F 3/08*** | (2006.01) |
| ***A61J 1/20*** | (2006.01) |
| ***A61J 3/00*** | (2006.01) |
| ***B01F 11/00*** | (2006.01) |

(56) References Cited

U.S. PATENT DOCUMENTS

| | | | | |
|---|---|---|---|---|
| 3,071,351 | A * | 1/1963 | Brown et al. | 366/268 |
| 3,353,918 | A * | 11/1967 | Philip | 422/133 |
| 3,860,218 | A * | 1/1975 | Hurlimann | 366/268 |
| 4,350,650 | A * | 9/1982 | Cereghini | 264/39 |
| 4,832,500 | A * | 5/1989 | Brunold et al. | 366/268 |
| 4,876,038 | A * | 10/1989 | Wigglesworth et al. | 261/152 |
| 4,915,881 | A * | 4/1990 | Straw et al. | 261/152 |
| 6,402,364 | B1 * | 6/2002 | Esclar et al. | 366/160.4 |
| 6,485,692 | B1 * | 11/2002 | Freitag et al. | 422/130 |
| 6,566,461 | B2 | 5/2003 | Freitag et al. | |
| 6,575,019 | B1 * | 6/2003 | Larson | 73/54.04 |
| 6,799,884 | B2 * | 10/2004 | Sentmanat | 366/176.3 |
| 7,033,067 | B2 * | 4/2006 | Sentmanat | 366/76.7 |
| 7,080,936 | B1 * | 7/2006 | Simpson | 366/162.3 |
| 7,115,234 | B2 * | 10/2006 | Freitag et al. | 422/130 |
| 7,178,978 | B2 * | 2/2007 | Argentine et al. | 366/268 |
| 7,748,892 | B2 * | 7/2010 | McCoy | 366/176.3 |
| 7,878,704 | B2 * | 2/2011 | Bonnard | 366/268 |
| 2004/0120217 | A1 * | 6/2004 | Sentmanat | 366/267 |
| 2005/0213427 | A1 * | 9/2005 | Steckle et al. | 366/268 |
| 2005/0270897 | A1 * | 12/2005 | McCoy | 366/130 |
| 2011/0160700 | A1 * | 6/2011 | Nakamura et al. | 604/518 |

FOREIGN PATENT DOCUMENTS

| | | | |
|---|---|---|---|
| JP | 5-228210 | A | 9/1993 |
| JP | 7-232045 | A | 9/1995 |
| JP | 7-286748 | A | 10/1995 |
| JP | 2002-531238 | A | 9/2002 |
| JP | 2005-186026 | A | 7/2005 |
| WO | 00/32308 | A2 | 6/2000 |
| WO | 2007/083763 | A1 | 7/2007 |
| WO | 2007/116864 | A1 | 10/2007 |

* cited by examiner

*WHITE LINES INDICATE 5 MM IN PHOTOGRAPHS

DEVICE AND METHOD FOR AUTOMATICALLY PREPARING EMULSION DRUG

CROSS REFERENCE TO RELATED APPLICATIONS

This application is a national stage of PCT International application no. PCT/JP2009/065972 filed Sep. 7, 2009, which claims priority to Japanese application Serial No. 2008-229142 filed Sep. 5, 2008.

TECHNICAL FIELD

The present invention relates to an apparatus for automatically preparing an emulsion and a method of preparing the emulsion, in particular, an apparatus suitable for automatically preparing an emulsion of a biologically active peptide and a method of preparing such emulsion.

BACKGROUND OF THE INVENTION

When immune induction is conducted by using a peptide as an antigen, the peptide may be administered together with an adjuvant, which serves as an effective means for promoting an immune response. In this case, the adjuvant is an oil component such as liquid paraffin, and hence the peptide and the adjuvant are mixed with water and are emulsified before their administration.

As a technology for preparing such emulsion, there has been disclosed a method and a connector dedicated to the method. Specifically, in this method, a mixture of an oil adjuvant serving as an oil component and a peptide solution is agitated by causing the mixture to repeatedly move between syringes via the connector having a small diameter (refer to Patent Document 1).

However, generally, the preparation of the emulsion is manually conducted, and hence it is complicated and a burden is imposed on those who prepare the emulsion.

Therefore, for automation of the preparation of the emulsion, there has been proposed a pumping apparatus. Specifically, this apparatus performs pumping, by which the above-mentioned mixture is caused to move from one syringe through a connector into another syringe (reciprocating movement of syringe plungers). This apparatus includes: fixing tables for detachably fixing the syringes coupled to each other through the connector; and cooperating mechanisms for causing the syringe plungers of the syringes to reciprocatingly move in the same direction (refer to Patent Document 1). Patent Document 1: WO 2007/083763

BRIEF SUMMARY OF THE INVENTION

However, the cooperating mechanisms of the above-mentioned pumping apparatus press and pull each of the plungers if the fixing tables themselves are fixed so as not to move. The cooperating mechanisms cause the fixing tables to reciprocatingly move if each of the plungers is fixed so as not to move. Consequently, with this configuration of the cooperating mechanisms, when one plunger is pressed, another plunger is inevitably pulled.

Further, in the preparation of the emulsion, in any case where an apparatus for a manual preparation or an automated preparation is used, when a dynamic force for pressing and pulling is transmitted simultaneously to each of syringe plungers of two syringes coupled to each other, or when a dynamic force for pulling is transmitted to one syringe plunger in order to cause right and left syringe plungers to reciprocatingly move in the same direction, the air may be entrained into the cylinders, and hence there may be formed air bubbles. That would be because, when a speed for a pulling movement of the one syringe plunger is higher than a speed for a pressing movement of another syringe plunger, the air is entrained due to a pulling pressure from between the syringe plunger and the cylinder, which are engaging in a pulling movement, or from the coupling portion between the cylinder engaging in a pulling movement and the connector.

The emulsion having air bubbles in the above-mentioned manner cannot be used as a formulation. Therefore, there is a need for providing countermeasures for preventing the air from being entrained into the cylinders.

In addition, the emulsion is needed to be homogeneous.

In the above-mentioned conventional technology, there has been disclosed a method. Specifically, in the method, the number of pumping is taken as an indicator of the completion of the emulsion. The emulsion is obtained by performing thirtieth times or more of pumping. However, in such method, due to some conditions upon the preparation of the emulsion, such as the kind of the peptides, a reciprocating speed of the syringe (speed of pumping), a moving speed of the solution, the number of the reciprocation of the syringe plungers (i.e., the number of pumping is varied, which is needed for the preparation of the emulsion. Therefore, it is difficult to obtain the indicator of the completion of the emulsion by using the number of the reciprocation of the syringe plungers. In addition, pumping is continued even after the completion of the emulsion, and hence there is a fear in that the stability of the emulsion is affected. Consequently, a determination whether or not the emulsion is completed depends mainly on the subjective determination of those who prepare the emulsion. Thus, it is not easy to prepare a homogeneous emulsion.

Due to the fact described above, in order to set an objective indicator of the completion of the emulsion, which is applicable to the preparation of the emulsion of various kinds of peptides, it is desirable to set the indicator which is easily detected upon the preparation of the emulsion and which is common among the various kinds of the peptides.

Therefore, it is an object of the present invention, in the preparation of the emulsion by causing the mixture to flow from the one syringe through the connector into the another syringe, to prevent the air from being entrained into cylinders and to prepare the emulsion containing no air bubble.

In addition, it is another object of the present invention to set the indicator, which is easily detected upon the preparation and which is common among the various kinds of the peptides, so as to easily prepare the homogeneous emulsion and so as to allow the completion of the emulsion to be easily known.

In order to solve the above-mentioned problems with the conventional technology, according to the present invention, a syringe pressing apparatus includes: a syringe fixing mechanism for fixing two syringes to a casing, the two syringes being coupled to each other through a connector; and a pressing mechanism for alternately pressing syringe plungers of the two syringes.

Further, in the syringe pressing apparatus, the syringe fixing mechanism detachably fixes the two syringes to the casing, the two syringes being coupled to each other through the connector. Further, the pressing mechanism includes: at least one pair of pressing sections for alternately pressing the syringe plungers of the two syringes; a driving source for driving the pressing sections; and a power transmission mechanism for transmitting a movement of the driving source to the pressing sections so as to cause the pressing sections to linearly and reciprocatingly move.

Further, the syringe pressing apparatus further includes a plunger-pressure-measuring device for measuring a pressure with which the pressing mechanism presses the syringe plungers.

Further, the syringe pressing apparatus further includes a control device for controlling the pressing mechanism correspondingly to the pressure with which the pressing mechanism presses the syringe plungers, the pressure being measured by the plunger-pressure-measuring device.

Further, in the syringe pressing apparatus, the control device controls the pressing mechanism, when the pressure of pressing the syringe plungers reaches a pressure which is predetermined times as large as an initial pressure pressing of the syringe plungers or when the pressure of pressing the syringe plungers reaches a predetermined pressing pressure.

Further, the syringe pressing apparatus further includes a cooling device for cooling the driving source.

Further, the syringe pressing apparatus further includes a timer for managing a driving time period of the pressing mechanism.

Further, the syringe pressing apparatus further includes a pressure-informing mechanism for informing that the pressure of pressing the syringe plungers reaches a predetermined pressure, the pressure being measured by the plunger-pressure-measuring device.

Further, the syringe pressing apparatus further includes a stopping-informing mechanism for informing stopping of the pressing mechanism.

Further, in the syringe pressing apparatus, each of the pressing sections is provided with an adjusting member for adjusting a distance between each of the pressing sections and each of the syringe plungers.

The syringe pressing apparatus can be suitably used as a syringe pressing apparatus for emulsion production, for producing an emulsion by agitating a raw material of the emulsion in the syringes.

Further, the syringe pressing apparatus can be suitably used as a pressing force-measuring apparatus for the syringe plungers, for measuring a pressure with which the syringe plungers press an object injected into the syringes.

In addition, a method of producing an emulsion includes: installing two syringes, into which a raw material of the emulsion is injected and which are coupled to each other through a connector, in the syringe pressing apparatus; alternately pressing syringe plungers; causing the raw material of the emulsion to move between the syringes via the connector so as to be agitated; and preparing the emulsion.

Further, the method of producing the emulsion further includes: measuring a pressure of pressing the syringe plungers; and controlling a pressing pressure of the syringe plungers correspondingly to the measured pressure.

Further, a method of evaluating completion of an emulsion includes: installing two syringes, into which a raw material of the emulsion is injected and which are coupled to each other through a connector, in the syringe pressing apparatus; alternately pressing syringe plungers; causing the raw material of the emulsion to move between the syringes via the connector so as to be agitated and measuring a pressure of pressing the syringe plungers; and informing that the measured pressure reaches a predetermined pressure.

According to the present invention as described above, in the preparation of the emulsion by causing the mixture to flow from the one syringe through the connector into the another syringe, it is possible to prevent the air from being entrained into the cylinders, and hence possible to prepare the emulsion containing no air bubble.

In addition, it is possible to use the indicator which is easily detected upon the preparation and which is common among the various kinds of the peptides, and hence possible to easily prepare the homogeneous emulsion. In addition, it is possible to easily know the completion of the emulsion.

DETAILED DESCRIPTION OF THE INVENTION

Description of Symbols

Figure 1:
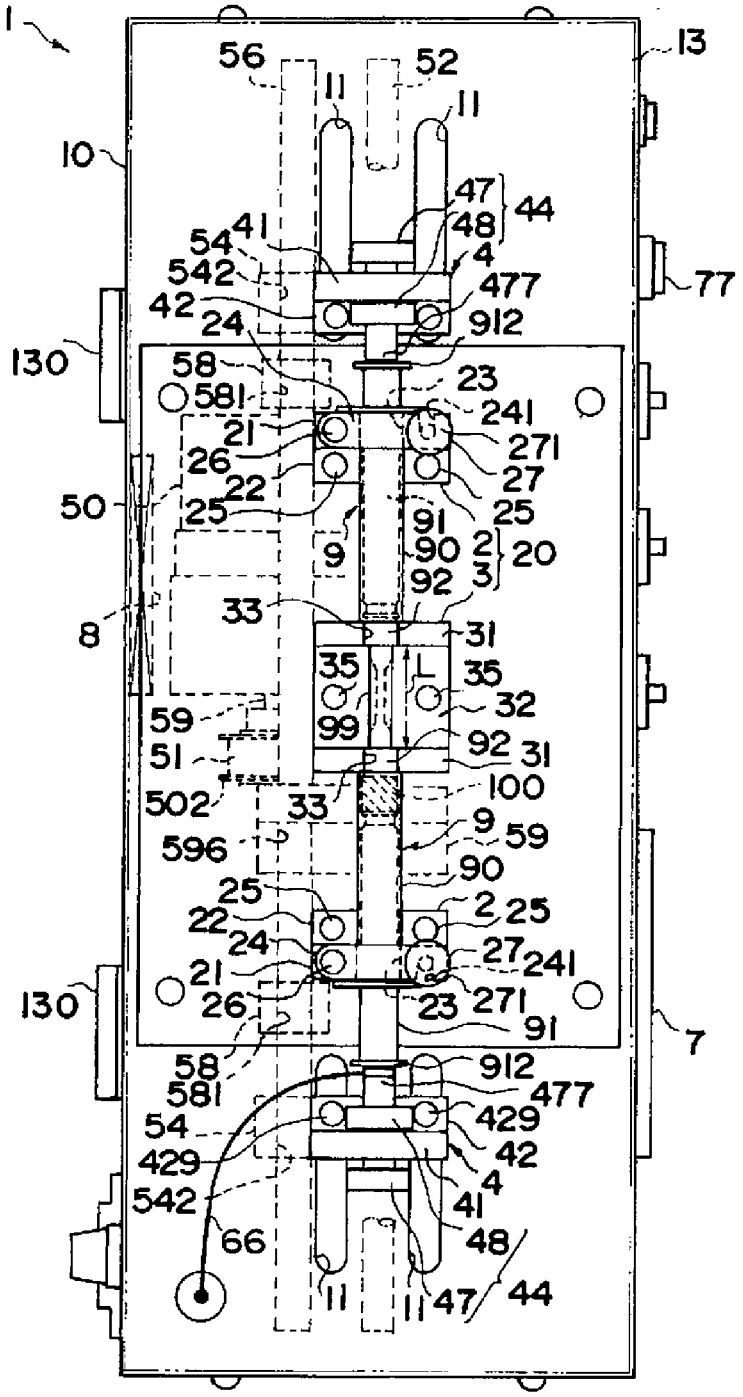
FIG. 1 is a top view of a first embodiment according to the present invention in a used state.
Figure 2:
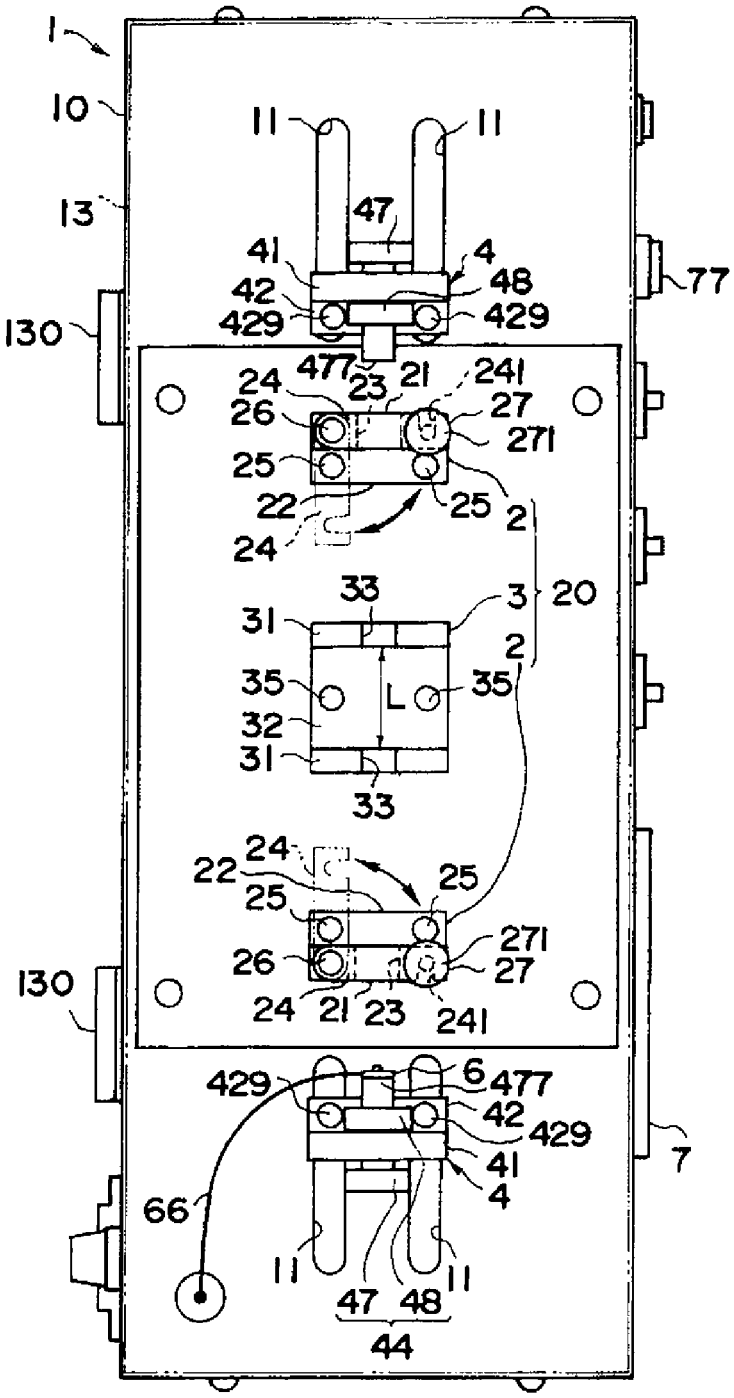
FIG. 2 is a top view of the first embodiment according to the present invention.

1 syringe pressing apparatus
10 casing
100 object to be agitated
2 syringe fixing table
24 holding plate
20 syringe fixing mechanism
3 syringe supporting table
4 pressing section
40 pressing mechanism
44 adjusting member
47 adjusting screw
48 adjusting nut
5 power transmission mechanism
50 motor
52 threaded shaft
54 nut
56 rotation-preventing shaft
6 compressed load cell
9 syringe
90 syringe body
91 syringe plunger
99 connector In the following, the embodiments according to the present invention are described with reference to the drawings. As illustrated in FIGS. 1 to 4, a syringe pressing apparatus 1 includes a syringe fixing mechanism 20 and a pressing mechanism 40 in a casing 10. The syringe fixing mechanism 20 is for fixing two syringes 9 to the casing 10, the two syringes 9 being coupled to each other through a connector 99. The pressing mechanism 40 is for alternately pressing a pair of syringe plungers 91 of the syringes 9.

Figure 6:
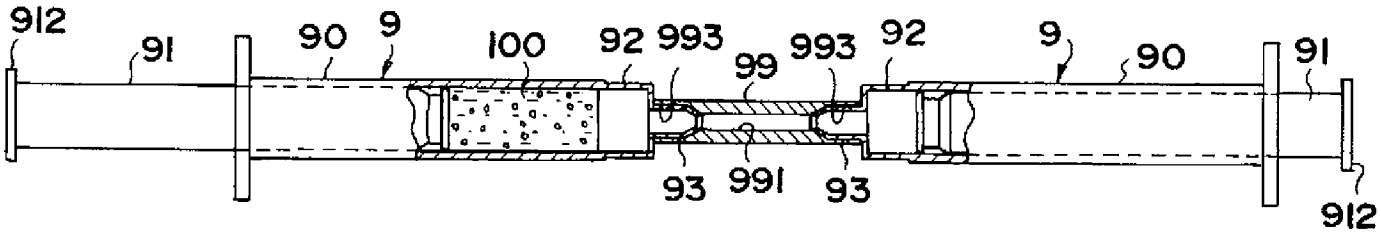
FIG. 6 is a side view of syringes coupled to each other through a connector used in the present invention.

In the syringe pressing apparatus 1, the syringe plungers 91 are alternately pressed, and hence an object to be agitated 100 in the two syringes 9 coupled to each other through the connector 99 may be agitated while being caused to move from one syringe 9 via the connector 99 into another syringe 9. Each of the syringes 9 used in the syringe pressing apparatus 1 includes, as illustrated in FIG. 6, a syringe body 90 and the syringe plunger 91. At a tip end of the syringe body 90, there is a tip end portion 92 formed so as to have a smaller diameter than a diameter of other portion of the syringe body 90. From the tip end of the tip end portion 92, a most tip end portion 93 extends, which is formed so as to have a smaller diameter than the diameter of the tip end portion 92. The connector 99 is formed into a cylindrical shape so as to include a flowing path 991 having both open ends and a small diameter. At the both end portions of the connector 99, there are provided fitting portions 993 each having a larger diameter than the diameter of the flowing path 991, into which the most tip end portions 93 of the syringes 9 are fitted Into both of the fitting portions 993 of the connector 99, the most tip end portion 93 of each of the syringes 9 is inserted and fitted so as to couple two syringes 9 via the connector 99 in a hermetically sealed manner. Thus, they become one set. Note that, the shape of the syringes 9 is not limited to the above-mentioned shape as long as the two syringes 9 are coupled to each other via the connector 99 in a hermetically sealed manner.

In addition, it is sufficient that, as the syringes 9 and the connector 99 used in the present invention, those conventionally used for preparing the emulsion are used. For example, there are used the syringe bodies 90, which have a sectional area equal in size to or larger than a sectional area of the flowing path 991 portion having the small diameter in connector 99. However, it is preferred that the syringe bodies be used, which have more than twice the sectional area of the flowing path 991 portion having the small diameter in connector 99. In addition, though an inner diameter of the flowing path 991 having a circular section in connector 99 is not particularly limited, it is preferably about 0.5 to 2.0 mm, and a length of the flowing path 991 portion having a small diameter is preferably about 5 to 20 mm.

The syringe fixing mechanism 20 is a mechanism for restricting movement of the syringe bodies 90 of the syringes 9 and fixing the syringe bodies 90 and the connector 99 to the casing 10. The syringe fixing mechanism 20 includes: a pair of syringe fixing tables 2 provided on a top surface of the casing 10; and a syringe supporting table 3 provided substantially in a center between the pair of syringe fixing tables 2 and 2. The pair of syringe fixing tables 2 and the syringe supporting table 3 are linearly arranged.

Figure 5:
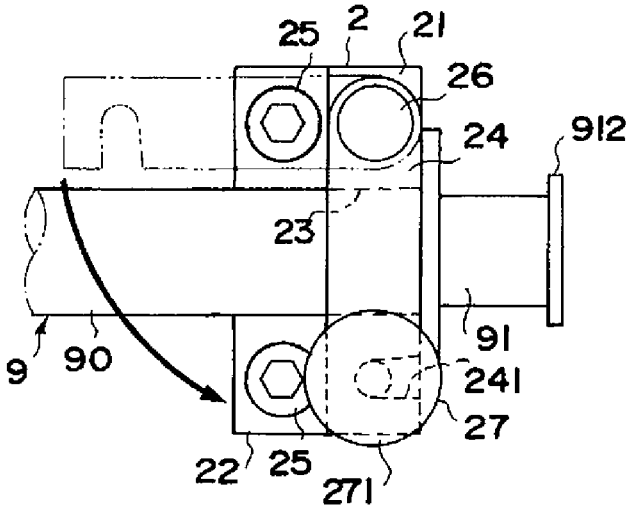
FIG. 5 is a partially enlarged view of the first embodiment according to the present invention.

The syringe fixing tables 2 are members for retaining the syringe bodies 90 of the syringes 9 and fixing the syringe bodies 90 to the casing 10. As illustrated clearly in FIG. 5, the syringe fixing tables 2 are members each having an L-shaped section by providing a vertical piece 21 to an end portion of a horizontal piece 22 so that the vertical piece 21 is perpendicular to the horizontal piece 22. The syringe fixing tables 2 are fixed to the casing 10 by using screws 25 which pass through threaded holes provided to the horizontal piece 22. The vertical piece 21 is provided with an installing recessed portion 23 having a substantial U-shaped longitudinal section. Into the installing recessed portion 23, the syringe 9, specifically the syringe body 90 is inserted from above for installation. Above the vertical piece 21, a holding plate 24 for covering the installing recessed portion 23 from above and holding the installed syringe 9 is axially and rotatably supported.

At one end portion of the holding plate 24, there is provided a supporting hole, into which a supporting screw 26 is inserted. At another end portion of the holding plate 24, there is provided a fixing recessed portion 241, into which a threaded portion of a fastening screw 27 is inserted. On both sides of the installing recessed portion 23 positioned on a top surface of the vertical piece 21, there is provided threaded hole. The supporting screw 26 is inserted into the supporting hole of the holding plate 24 and screwed into one threaded hole so as to rotatably support the holding plate 24 to the syringe fixing table 2. The fastening screw 27 is screwed into another threaded hole, and the threaded portion of the fastening screw 27 is then inserted into the fixing recessed portion 201 after rotating the holding plate 24. Thus, the fastening screw 27 is fastened in such a state that the holding plate 24 is sandwiched between a screw head 271 of the fastening screw 27 and the vertical piece 21. As a result, the holding plate 24 is fixed. With this configuration, it is possible to detachably fix a set of two syringes 9, which are coupled to each other through the connector 99, to the casing 10.

A shape of the installing recessed portion 23 is not particularly limited as long as it is possible to install therein the syringe 9 to be used and possible to prevent movement of the syringe 9 by the holding plate 24. The installing recessed portion 23 may have a shape such as a V-shape other than a substantial U-shape. It is preferred that, in order to securely fix the syringe 9, a bottom portion of the installing recessed portion 23 have an identical shape to a shape of the syringe body 90 of the syringe 9 to be used. In addition, the installing recessed portion 23 may have a depth D having the same length as a diameter of the syringe body 90 of the syringe 9 to be used. It is preferred that, in order to securely fix the syringe 9, the depth D be slightly smaller than the diameter of the syringe body 90, and specifically, be smaller than the diameter of the syringe body 90 by 0.1 to 0.4 mm, preferably by 0.2 to 0.3 mm. Despite that, a method of fixing the syringe 9 is not limited as long as it is possible to securely fix the syringe 9.

The syringe supporting table 3 is a member for retaining the tip end portions 92 of the syringe bodies 90 and restricting movement of the syringe bodies 90. The syringe supporting table 3 is a member having a C-shaped section obtained by providing vertical pieces 31 to both opposed ends of a horizontal piece 32 so that the vertical pieces 31 are perpendicular to the horizontal piece 32. The syringe supporting table 3 is fixed to the casing 10 by using screws 35 which pass through threaded holes provided to the horizontal piece 32. The vertical piece 31 is provided with an installing recessed portion 33 having a substantial U-shaped longitudinal section. Into the installing recessed portion 33, tip end portion 92 of the syringe body 90 is inserted from above for installation. A length_L between the vertical pieces 31 and 31 is set to be equal to or larger than a length of the connector 99 to be installed.

Similarly to the installing recessed portion 23, a shape of the installing recessed portion 33 is not particularly limited as long as it is possible to install therein the syringe 9 to be used. The installing recessed portion 33 may have a shape other than a substantial U-shape. It is preferred that, in order to securely fix the syringe 9, a bottom portion of the installing recessed portion 33 have an identical shape to a shape of the tip end portion 92 of the syringe body 90 of the syringe 9 to be used. In addition, a length L between the vertical pieces 31 and 31 is set to be equal to or larger than the length of the connector 99 to be installed. In addition, heights of the vertical pieces 31 and depths of the installing recessed portions 33 are set to be corresponding to the vertical pieces 21 and a depth of the installing recessed portions 23 of the syringe fixing tables 2. Thus, the two syringes 9 are linearly retained, which are coupled to each other through the connector 99 to be installed.

The pressing mechanism 40 includes: pressing sections 4 for alternately pressing the syringe plungers 91 of the two syringes 9; a driving source for driving the pressing sections 4 so as to cause the pressing sections 4 to linearly and reciprocatingly move; and a power transmission device 5 for transmitting movement of the driving source to the pressing sections 4 so as to cause the pressing sections 4 to linearly and reciprocatingly move. The pressing sections 4 are arranged in a pair on the top surface of the casing 10 so as to be opposed to each other. The driving source and the power transmission device 5 are provided in the casing 10.

Figure 4:
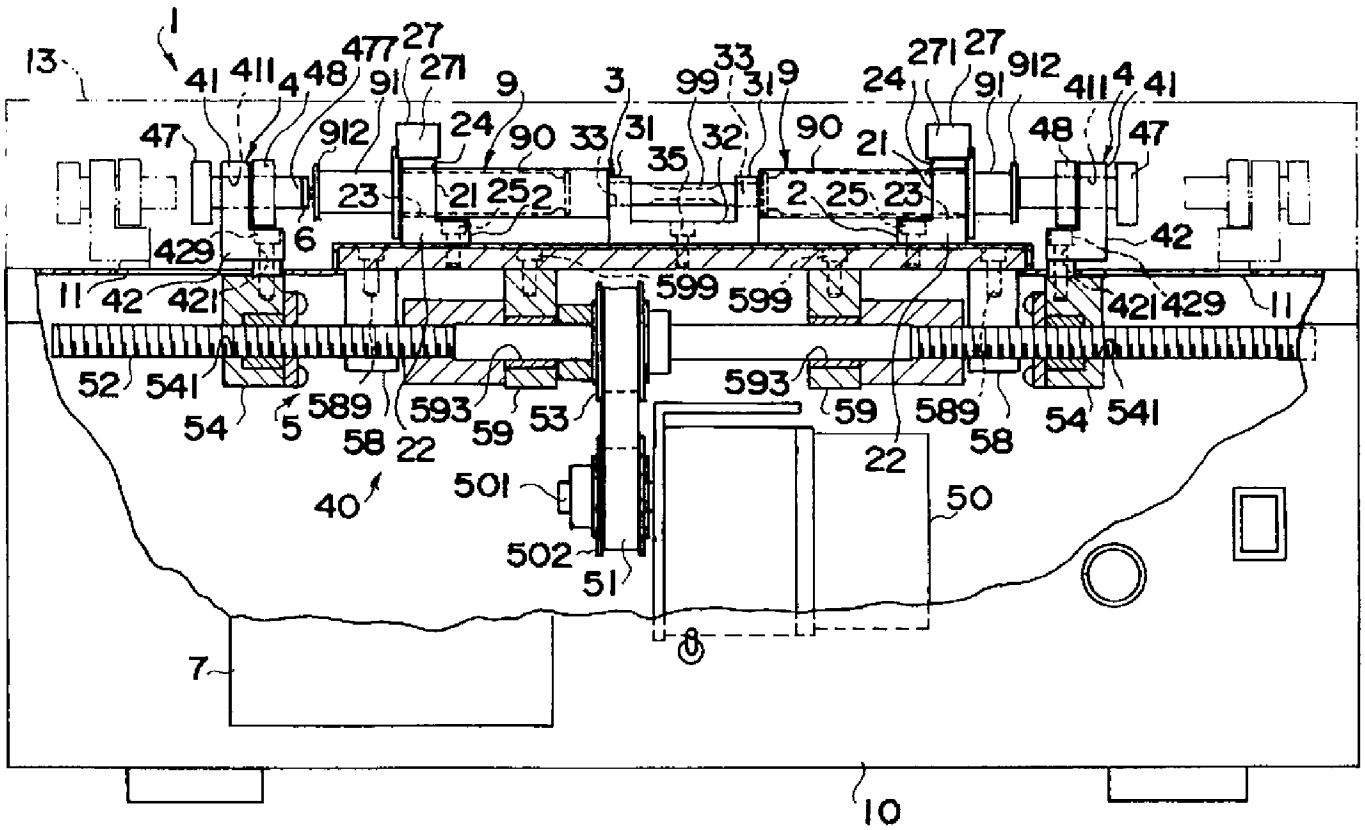
FIG. 4 is a side view of the first embodiment according to the present invention in the used state, which is illustrated in a partially broken state.

The power transmission device 5, as illustrated in FIGS. 1 and 4, include a belt 51, a threaded shaft 52, a pulley 53, a pair of nuts 54, and a rotation-preventing shaft 56. The threaded shaft 52 is inserted into bearing holes 593 of bearings 59 which are fixed to the casing 10 with threads 599, and the threaded shaft 52 is axially and rotatably supported by the bearings 59. The pulley 53 is fixed substantially in a center of the threaded shaft 52. The rotation-preventing shaft 56 is fixed to the casing 10 so as to be parallel to the threaded shaft 52. Two bearings 59 are provided while sandwiching the pulley 53, and support the threaded shaft 52 in an intermediate portion. However the number and the position of the bearings 59 to be installed are not limited as long as it is possible to axially and rotatably support the threaded shaft 52. For example, the bearings 59 may be installed to both end portions of the threaded shaft 52. In addition, two fixing blocks 58 are fixed to the casing 10 by using screws 589 at a predetermined space. By being inserted into inserting holes 581 of the two fixing blocks 58, the rotation-preventing shaft 56 is fixed. Further, the rotation-preventing shaft 56 may be rigidly fixed by being inserted also into through-holes 596 provided to the bearings 59.

As the nuts 54, ball screw nuts are suitably used. In each of the ball screw nuts, there are provided a threaded hole 541 and an inserting hole 542. The threaded shaft 52 is inserted into the threaded hole 541, and the rotation-preventing shaft 56 is inserted into the inserting hole 542. A pair of the nuts 54 and 54 is installed on both sides of the threaded shaft 52 at a predetermined space while sandwiching the pulley 53. The threaded shaft 52 is inserted into the threaded hole 541. The ball screw nuts are mounted via balls rolling along threaded grooves. At the same time, the rotation-preventing shaft 56 is inserted into the inserting hole 542. Note that, it is sufficient that a space between the pair of the nuts 54 and 54 is set to be corresponding to the two syringes 9 coupled with each other through the connector 99 to be installed, and amount of the object to be agitated 100 in syringes, that is, a distance between heads 912 of the pair of the syringe plungers 91. With this configuration, rotation of the nuts 54 due to rotation of the threaded shaft 52 is prevented. In addition, the reciprocating movement of the nuts 54 in a longitudinal direction of the threaded shaft 52 is allowed while the pair of the nuts 54 and 54 being always positioned at a predetermined space.

The power transmission device 5 converts the movement of the driving source into a linear reciprocating movement if needed. The power transmission device 5 is not limited to the above-mentioned configuration as long as it is possible to transmit the movement of the driving source to the pressing sections 4. Components of the power transmission device 5 may be appropriately alternated with the other members. For example, in place of the threaded shaft 52 and the nuts 54, a rack and pinion mechanism or crank mechanism may be used.

As the driving source, as illustrated in FIG. 4, a motor 50 is used. The motor 50 is connected to an electric power supply (not shown) and fixed to the interior of the casing 10. In addition, the motor 50 is connected to a control device (not shown) which is installed in the casing 10, and the motor 50 is set to repeat normal rotation and counter rotation at each predetermined time which is preset in accordance with a preset program. Note that, as the control device, it is possible to use a control circuit, computer, or the like. Thus, it is possible to set driving and stopping of the driving source, a time period and a speed of the normal rotation and the counter rotation, and the like by using a switch and a cock (not shown) which are provided to a control board 7 provided on the casing 10. A pulley 502 is fixed to a rotational shaft 501 of the motor 50. The pulley 502 and the pulley 53 are coupled to each other via the belt 51. Note that, the driving source is not limited to the motor, and that it is also possible to use a publicly known driving source such as an electric cylinder, a pneumatic cylinder, or a hydraulic cylinder.

Note that, there is a fear in that the emulsion to be prepared is deteriorated due to heat generating from the driving source such as the motor 50, and hence it is preferred to install a cooling device for cooling the driving source such as the motor 50. As the cooling device, as illustrated in FIG. 1, a cooling fan 8, a heat pipe, or the like may be used, which is installed in vicinity of or in contact with the driving source such as the motor 50.

Each of the pressing sections 4 includes, as illustrated clearly in FIGS. 1 and 4, a member having an L-shaped section by providing a vertical piece 41 to an end portion of a horizontal piece 42 so that the vertical piece 41 is perpendicular to the horizontal piece 42. Each of the pressing sections 4 is fixed to the nut 54 by using screws 429 which passes through threaded holes 421 provided in the horizontal piece 42 in such a manner that the vertical piece 41 is opposed to a head 912 of the syringe plunger 91 of the syringe 9 to be installed. Therefore, a pair of two pressing sections 4 is installed correspondingly to the number of syringes 9 to be installed. The screws 429 are inserted into elongated holes 11. The elongated holes 11 are provided on the top surface of the casing 10 and formed so as to be elongated in the longitudinal direction of the threaded shaft 52. Thus, the pressing section 4 on the top surface of the casing 10 and nut 54 in the casing 10 are coupled to each other. It is sufficient that the pressing sections 4 are provided so as to be capable of alternately pressing the syringe plungers 91 and 91 of the two syringes 9 and 9 coupled to each other through the connector 99 as one set, correspondingly to the number of the set to be installed of two syringes 9 coupled to each other through the connector 99. It is sufficient that at least one pair of the pressing sections 4 is appropriately provided. For example, when the number of the set to be installed of two syringes 9 is one, a pair of two pressing sections 4 is provided, and when the number of the set to be installed of two syringes 9 is two, two pairs of four pressing sections 4 are provided.

When the syringe plungers 91 are pressed by actuating the syringe pressing apparatus 1, the heads 912 of the syringe plungers 91 may be pressed directly by the vertical pieces 41. It is preferred that adjusting members 44 be provided to the pressing section 4, for adjusting a distance between each of the pressing sections 4 and each of the syringe plungers 91. Each of the adjusting members 44 includes an adjusting screw 47 and an adjusting nut 48. The vertical piece 41 is provided with a threaded hole 411. The adjusting screw 47 is inserted into the threaded hole 411 and then fixed by the adjusting nut 48. A flat tip end 477 of the adjusting screw 47 is opposed to and abutted against the head 912 of the syringe plunger 91. As a result, the pressing section 4 is allowed to press the syringe plunger 91 at the flat tip end 477 of the adjusting screw 47. With this configuration, it is possible to easily adjust the distance between each of the syringe plungers 91 and the each of the pressing sections 4, and hence it is possible to easily accommodate the position of each of the syringe plungers 91 which is changed due to the change of the amount of the object to be agitated 100 in syringes 9, the length of syringes 9 or the like.

Further, the syringe pressing apparatus 1 preferably includes a plunger-pressure-measuring device for measuring a pressure with which the pressing mechanism 40 presses the syringe plungers 91.

In order to solve the problems when the number of pumping is used as an indicator of the completion of the emulsion as in a case of the prior art, consideration was made on the other indicator, and a force pressing the syringe plungers was featured. As a result, it became clear that a force pressing the syringe plungers increases rapidly just before complete emulsification and exceeds a force pressing the syringe plungers at an initial period of the preparation, that is, upon the start of pumping. Thus, it was found that when mixture of an oil component and of a peptide solution is agitated by being caused to repeatedly move between the syringes via the connector so as to prepare the emulsion, it is possible to use a pressing force of the syringe plungers as an indicator of the completion of the emulsion. In light of this situation, it is clear that it becomes possible to prepare the homogeneous emulsion by setting the pressing force of the syringe plungers as the indicator of the completion of the emulsion. Therefore, by providing the plunger-pressure-measuring device, in the syringe pressing apparatus 1, it becomes possible to use the pressing force of the syringe plungers as the indicator, and hence possible to prepare the homogeneous emulsion.

In addition, by providing the plunger-pressure-measuring device in the syringe pressing apparatus 1, in addition to its suitable use for preparing the emulsion, it is possible to use the syringe pressing apparatus 1 according to the present invention as a pressing-pressure-measuring instrument for the syringe plungers so as to measure a pressure with which the syringe plungers press an object injected into the syringes, for example, an object to be agitated which is a raw material of the emulsion. Thus, it is also possible to use the syringe pressing apparatus 1 according to the present invention as a tool for research and development of the preparation of a various kinds of the formulations.

As the above-mentioned plunger-pressure-measuring device, for example, a compressed load cell 6 may be used as appropriately illustrated in FIGS. 1 to 4. The compressed load cell 6 may be installed by opposing to one of the heads 912 of the syringe plungers 91 and being fixed to the vertical piece 41 of one of the pressing sections 4 or to the tip end 477 of one of the adjusting screws 47 with adhesive or the like. A cable 66 of the compressed load cell 6 is connected to a control device (not shown). The control device controls the pressing mechanism 40 correspondingly to a pressure with which the pressing mechanism 40 presses the syringe plungers 91, the pressure being measured by the compressed load cell 6. That is, a value of the pressure with which the pressing mechanism 40 presses the syringe plungers 91, the pressure being measured by the compressed load cell 6 is send to the control device. In the control device, a signal of the value of the pressure from compressed load cell 6 is computed in accordance with a control program which is previously incorporated. The driving source and even the pressing mechanism 40 are controlled correspondingly to the pressure with which the pressing mechanism 40 presses the syringe plungers 91. Thus, the syringe pressing apparatus 1 is controlled. Note that, as the control device, it is possible to use a control circuit, computer, or the like. In this case, such control device may be set by the switch and the cock (not shown) which is provided to the control board 7 provided on the casing 10. Such control device may be cooperated with a control device for controlling driving of the driving source and the like.

Note that, as the plunger-pressure-measuring device, in addition to the compressed load cell 6, other compressed load meters or other various kinds of the pressure sensors, which are publicly known, may be used. In addition, the pressure measured by the plunger-pressure-measuring device may be displayed on a display device 71 (refer to FIG. 3) which is provided to the control board 7 sequentially or when the pressure reaches a predetermined value. Further, when the pressure measured by the plunger-pressure-measuring device reaches a predetermined value, a lamp (not shown) may be illuminated. In other words, these display device 71 and lamp are pressure-informing mechanisms for informing that the pressure pressing the syringe plungers 91, which is measured by the plunger-pressure-measuring device, reaches a predetermined value.

In addition, the syringe pressing apparatus 1 may be provided with a timer. The timer allows the following. Specifically, the timer may manage the driving time period of the pressing mechanism. The timer may be set to automatically turn off a switch of an electric power supply or the motor 50 so as to stop the driving of the motor 50. The timer may set the agitating time period to a preset predetermined time period. Note that, the timer may be configured by a program incorporated in the control device, or may be configured by a timer device which is publicly known and is separated from the above-mentioned control device.

In addition, there may be provided a stopping-informing mechanism (not shown) for informing the stopping of the pressing mechanism 40. The stopping-informing mechanism may include a control device and speaker, for example. Upon sensing the stopping of the motor 50, the control device may inform the stopping by alarming via the speaker in accordance with a previously incorporated program.

In addition, an upper portion of the casing 10, there are preferably provided a lid 13 for covering the connector 99 and the syringes 9 which are installed, the lid 13 being axially supported on the casing 10 by hinge 130 so as to be allowed to be opened and closed, and covering the upper portion of the casing 10.

Figure 3:
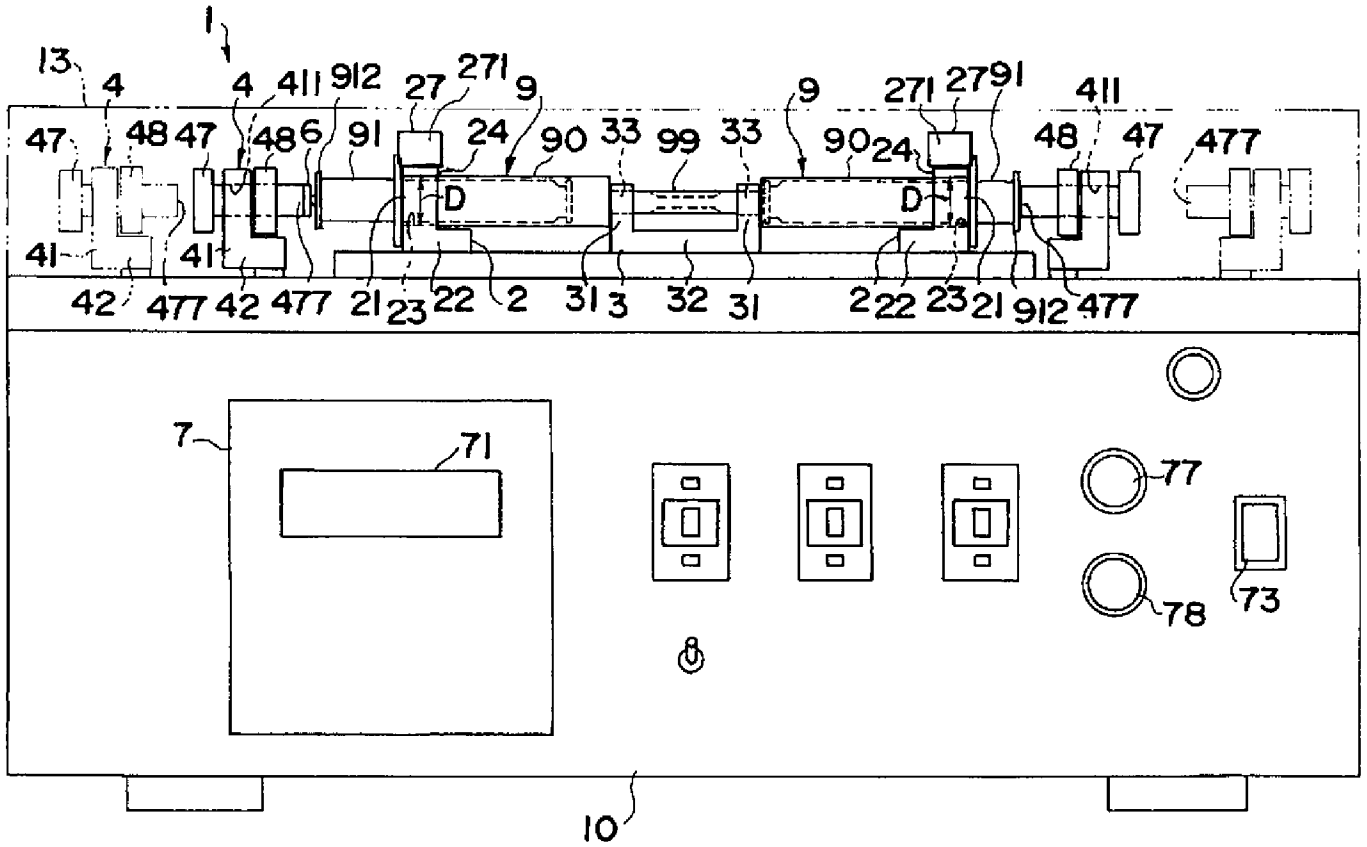
FIG. 3 is a side view of the first embodiment according to the present invention in the used state.

In the following, operations and a method of using the syringe pressing apparatus 1 and a method of producing the emulsion and a method of evaluating the completion of the emulsion by using the syringe pressing apparatus 1 are simultaneously described (refer to FIG. 1, FIG. 3, and FIG. 4). At first, the connector 99, the two syringes, and a raw material of the emulsion to be prepared (object to be agitated 100), such as an oil adjuvant and a peptide solution are prepared. The raw material is sucked into the syringes 9. In this case, all the raw material may be sucked into one syringe of the two syringes 9, or different raw materials may be sucked into each of the syringes 9. Then, the two syringes 9 are coupled to each other via connector 99.

Next, the two syringes 9 coupled to each other via connector 99 are fixed to the casing 10 of the syringe pressing apparatus 1 by the syringe fixing mechanism 20. Specifically, each of the syringe bodies 90 is inserted into the installing recessed portion 23 of the syringe fixing table 2 from above, and each of the tip end portions 92 of the syringe bodies 90 is inserted into each of the installing recessed portions 33 of the syringe supporting table 3. At the same time, the connector 99 is inserted between the vertical pieces 31 and 31 of the syringe supporting table 3. Then, the holding plates 24 of the syringe fixing tables 2 are rotated and fixed by the fastening screws 27. Thus, the syringe bodies 90 are fixed to the syringe fixing tables 2. In this manner, the movement of the syringe bodies 90 are restricted. Actually, the movement of each of the syringe bodies 90 to the tip end direction is further restricted also by a step portion being engaged with the vertical piece 31 of the syringe supporting table 3, the step portion situating on a base of the tip end portion 92 of the syringe body 90.

In the syringes 9 installed to the casing 10 as described above, the heads 912 of the syringe plungers 91 are opposed to the vertical pieces 41 of the pressing sections 4 of the pressing mechanism 40, respectively. The adjusting screws 47 and the adjusting nuts 48 are then adjusted, respectively. Then, the frat tip end 477 of each of the adjusting screws 47 is brought into a close contact with or abutted against the head 912 of the syringe plunger 91 or the compressed load cell 6 is brought into a close contact with or abutted against the head 912 of each of the syringe plungers 91 if the compressed load cell 6 is installed to the tip end 477 of one of the adjusting screws 47.

Next, the switch 73 of the electric power supply is turned on. As needed, the agitating time period, the agitating speed, the value of the pressure for pressing the syringe plungers 91, at which the motor should be stopped, and the like are set by the switch and the cock (not shown) which are provided on the control board 7.

Then, the switch 77 for starting the driving of the motor 50 is depressed so as to actuate the motor 50. The rotation of the motor 50, which repeats the normal rotation and the counter rotation under control of the control device, is transmitted to the threaded shaft 52 via the rotational shaft 501, the pulley 502, the belt 51, and the pulley 53. As a result, the threaded shaft 52 repeat the normal rotation and the counter rotation. Due to the movement of the threaded shaft 52, a pair of the nuts 54 and 54 moves linearly and reciprocatingly in the longitudinal direction of the threaded shaft 52, while being always retained at an identical space.

Each of the nuts 54 is fixed to the pressing section 4, and hence, due to the above-mentioned movement of the nuts 54, a pair of the pressing sections 4 also moves linearly and reciprocatingly in the longitudinal direction of the threaded shaft 52, while being always retained at an identical space. Due to the movement of the pressing sections 4, the flat tip end 477 of the adjusting screw 47 or the compressed load cell 6 abuts against and presses the head 912 of one syringe plunger 91. As a result, the syringe plunger 91 is inserted into the syringe body 90, and the object to be agitated 100 in the syringe body 90 is moved into the syringe body 90 of another syringe 9 via the connector 99.

The syringe plunger 91 of the syringe 9, into which the object to be agitated 100 flows, is pressed back from the syringe body 90 due to the pressure of the object to be agitated 100. The pressing section 4, which is opposed to the syringe plunger 91 pressed back, moves in an opposite direction to the direction in which the syringe 9 moves. Further, the pressing section 4 is not fixed to the syringe plunger 91, and hence the pressing section 4 does never interfere with the movement of the syringe plunger 91, and does not have any action of pulling the syringe plunger 91. Therefore, it is possible to prevent the air from being entrained into the cylinders, and hence possible to prepare the emulsion containing no air bubble.

When the one syringe plunger 91 is completely inserted into the syringe body 90, and discharges the object to be agitated 100, the rotation of the motor 50 is reversed by the control of the control device, and the direction of the movement of the pressing section 4 is changed. As a result, the syringe plunger 91 pressed back is pressed by the pressing section 4. The same action and actuation as described above are performed and further repeated. Thus, by alternately pressing the syringe plunger 91, the object to be agitated 100 in the two syringes 9 coupled to each other through the connector 99 having a small inner diameter is agitated while being caused to move from the one syringe 9 via the connector 99 into the another syringe 9. Thus, the emulsion is prepared.

For finishing the agitation, the electric power supply may be manually turned off, and specifically, a stopping switch 78 may be depressed. However, automatic stopping is preferably used. As a method for automatic stopping, the following method may be employed. Specifically, in the method, the motor 50 is automatically stopped by using the timer, by which the agitating time period is preset to a predetermined time period so as to turn off the electric power supply after the predetermined time period is passed. Thus, the motor 50 may be stopped.

In addition, the following method may be also employed. Specifically, in the method, the motor 50 is automatically stopped by using the plunger-pressure-measuring device such as the compressed load cell 6 and the control device. In addition, if the plunger-pressure-measuring device is used, a method may be employed, which controls the pressing mechanism, when the pressure pressing the syringe plungers 91 reaches a pressure which is predetermined times as large as a pressure (initial pressure) upon the initial period of actuation, that is, upon the start of pumping, or when the pressure pressing the syringe plungers reaches a predetermined pressing pressure. As a specific example of this method, the following methods may be employed. Specifically, in a method, the pressing mechanism 40 may be stopped by turning off the electric power supply when the pressure pressing the syringe plungers 91 reaches a preset predetermined pressure. In another method, the pressing mechanism 40 may be stopped by turning off the electric power supply, after the pressure pressing the syringe plungers 91 reaches a preset predetermined pressure and then a preset time period is passed. In still another method, the pressing mechanism 40 may be stopped by turning off the electric power supply when the pressure pressing the syringe plungers 91 reaches a pressure which is predetermined times as large as a pressure (initial pressure) upon the initial period of actuation, that is, upon the start of pumping. In still another method, the pressing mechanism 40 may be stopped by turning off the electric power supply, after the pressure pressing the syringe plungers 91 reaches a pressure which is predetermined times as large as a pressure (initial pressure) upon the initial period of actuation, that is, upon the start of pumping and then a preset time period is passed.

The compressed load cell 6 fixed to the one pressing section 4 abuts against the syringe plunger 91 in accordance with the reciprocating movement of the pressing section 4. The compressed load cell 6 then measures the pressure pressing the syringe plungers 91 and transfers a measurement result to the control device via the cable 66. The control device, correspondingly to the measured pressure, turns off the electric power supply, for example, when the measured pressure reaches a preset predetermined pressure, or when the measured pressure reaches a pressure which is predetermined times as large as a pressure upon the initial period of actuation. In this manner, the control device controls the pressing mechanism 40 and controls a pressing pressure of the syringe plungers 91. Thus, it becomes possible to prepare the homogeneous emulsion by setting the pressing forces of the syringe plungers as the indicator of the completion of the emulsion.

Further, the pressure pressing the syringe plungers 91, which is measured by compressed load cell 6, is displayed on the display device 71 sequentially or when the pressure reaches a predetermined value. In addition, when the pressure measured by compressed load cell 6 reaches a predetermined value, the lamp is illuminated. In this manner, these display device 71 and the lamp inform that the pressure pressing the syringe plungers 91 reaches a predetermined value, that is, they inform that the emulsion is completed. As a result, even when the pressing mechanism 40 is not automatically stopped, it is possible to evaluate and know whether or not the emulsion is completed.

Note that, as is clear also in the following examples, in the preparation of the emulsion, the following is varied due to the kind and the amount of raw material, the agitating speed, and the like: a pressure value for pressing the syringe plungers 91 upon the start of pumping; a pressure value for pressing the syringe plungers 91 upon the completion of the emulsion; a ratio between such pressure and the pressure value upon the start of pumping; a time period for completing the emulsion; and the like.

Therefore, in the preparation of the emulsion under some conditions such as the kind and the amount of raw material, the agitating speed, and the like, under which the preparation has not been performed before, it is difficult to set the above-mentioned pressure value, time, multiple, and the like, which are set in order to automatically stop the pressing mechanism 40. Thus, when the preparation is performed for the first time under a certain condition, it is sufficient to perform the following, for example. Specifically, the pressure value for pressing the syringe plungers 91 which is displayed on the display device 71 sequentially is observed with eyes so as to know that the pressure value increases rapidly. When a predetermined time period after this time point is passed, the pressing mechanism 40 is then caused to be stopped. In this manner, the preparation of the emulsion may be performed. In addition, in this first preparation, it is possible to know and derive the above-mentioned pressure value, time, multiple, and the like, which are set in order to automatically stop the pressing mechanism 40 under such condition. Thus, in the subsequent preparations of the emulsion after the first preparation under the same condition, it is possible to preset the pressure value, time, multiple, and the like in order to automatically stop the pressing mechanism 40. In this manner, it is possible to automatically stop the pressing mechanism 40, and hence it is possible to automate the preparation of the emulsion.

Note that, the object to be agitated 100 in the syringes 9 is not limited to the raw material of the emulsion. The object to be agitated 100 in the syringes 9 may be various kinds of formulations, their raw materials or the like, and the measurement of the pressing pressure of the syringe plungers may be performed in the above-mentioned manner. These processes may be used in apparatus and a method for a research and development of various kinds of formulations.

After the electric power supply is turned off and the reciprocating movements of the pressing sections 4 are stopped, the two syringes 9 coupled to each other through the connector 99 are detached from the syringe fixing mechanism 20. Then, the emulsion is ejected, which is prepared from the object to be agitated 100.

As described in the foregoing, the syringe pressing apparatus 1 may be used for the production of the emulsion. In addition, when the syringe pressing apparatus 1 includes the plunger-pressure-measuring device, the syringe pressing apparatus 1 may be also used as a pressing-pressure measuring instrument for the syringe plungers or for the evaluation of the completion of the emulsion.

Figure 7:
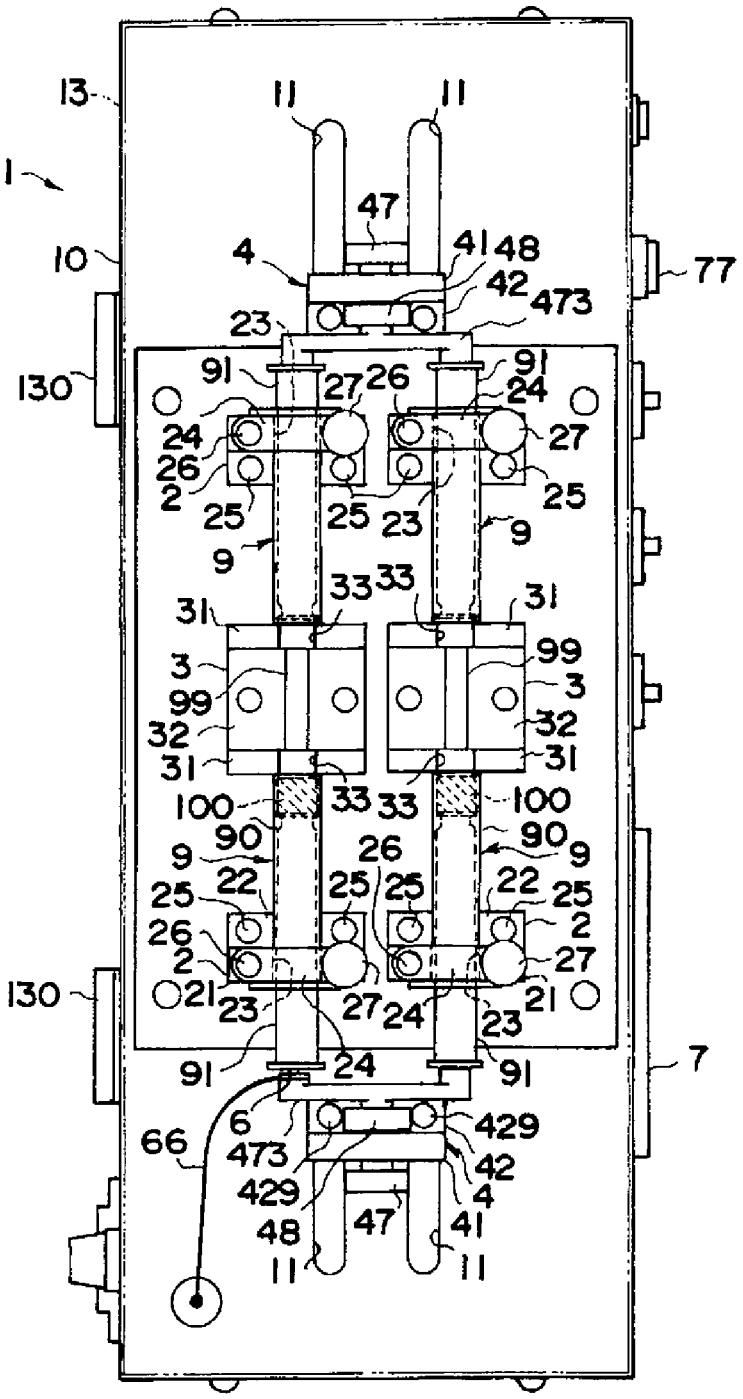
FIG. 7 is a top view of a second embodiment according to the present invention.

Though the above-mentioned syringe pressing apparatus 1 is described as one having the configuration where the two syringes 9 and 9 coupled to each other by the linear-shaped connector 99 are linearly installed in one set, the syringe pressing apparatus 1 according to the present invention is not limited to this form. As illustrated in FIG. 7, another configuration may be employed. Specifically, in this configuration, the two syringes 9 and 9 coupled to each other through the connector 99 are linearly installed in two sets while being arranged parallel to each other. Each of the syringes 9 is fixed by the syringe fixing mechanism 20 similar to that of the above-mentioned embodiment. Pressing members 473 are installed to the tip ends of the adjusting screws 47 of the pressing sections 4, the pressing members 473 being capable of pressing the heads 912 of the two syringe plungers 91 arranged in parallel to each other. Further, still another configuration may be employed. Specifically, in this configuration, it is possible to also employ a configuration in which the two syringes 9 and 9 coupled to each other through the connector 99 are linearly installed in three sets or more in parallel to each other. In addition, when the two syringes 9 and 9 coupled to each other through the connector 99 are linearly installed in two sets or more, it is not necessary to install each of the sets in parallel to each other. In this case, it is sufficient to appropriately increase the number of the pressing mechanism 40 and the syringe fixing mechanism 20 to be provided. In these configurations, other configurations not described may have a configuration similar to that of the above-mentioned embodiment.

Figure 8:
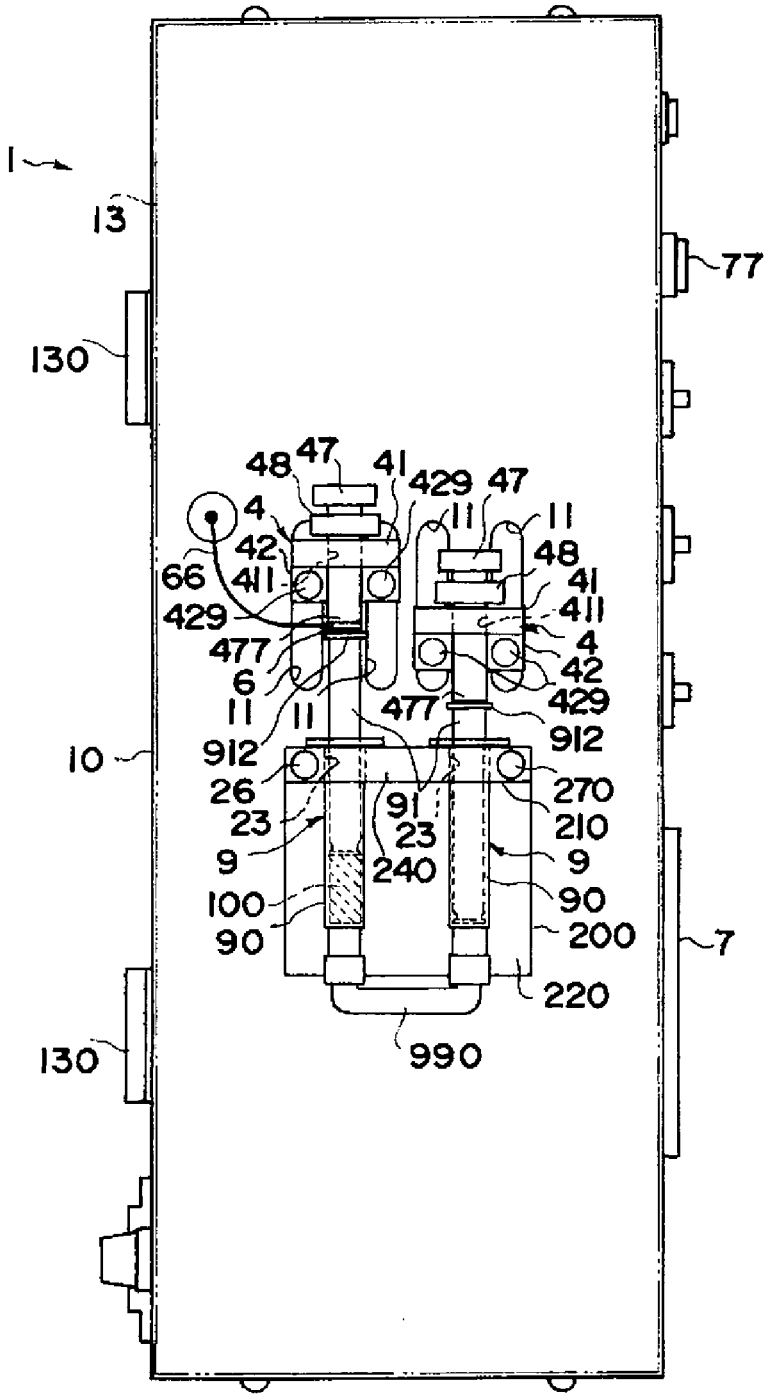
FIG. 8 is a top view of a third embodiment according to the present invention.

Further, in a syringe pressing apparatus 1, as illustrated in FIG. 8, a configuration may also be employed. Specifically, in this configuration, a connector 990 having a C-shape is used, and the two syringes 9 are arranged in parallel to each other so as to be one set. When such configuration is employed, the syringe fixing mechanism 20 is constituted by one syringe fixing table 200. The syringe fixing table 200 is a member having an L-shaped section by providing a vertical piece 210 to an end portion of a horizontal piece 220 so that the vertical piece 210 is perpendicular to the horizontal piece 220. The vertical piece 210 is provided with two installing recessed portions 23 having a substantial U-shaped longitudinal section. Into the installing recessed portions 23, the syringe bodies 90 are inserted from above for installation. The syringe fixing table 200 is provided with a holding plate 240 for holding the two syringes 9 to be installed. The pressing sections 4 are installed in one pair to be arranged in parallel to each other on the top surface of the casing 10. The power transmission mechanism 5 and the motor serving as the driving source, which are similar to those of the above-mentioned embodiments, are provided in two sets correspondingly to each of the pressing sections 4.

Note that, the syringe pressing apparatus according to the present invention is not limited to those described above in the embodiments, and the configurations described above in the embodiments may be appropriately combined with each other.

Example 1

In the above-mentioned syringe pressing apparatus 1 for the production of the emulsion in which the two syringes 9 coupled to each other through the connector 99 were fixed to the casing 10 as illustrated in FIG. 1, a sample was agitated under such a condition that the speed of the reciprocating movement of the syringe plungers 91 was set to 88 reciprocation/min or 116 reciprocation/min.

As a sample for the emulsification, normal saline solution 0.9 ml

IFA 1 ml

DMSO (containing 2 mg of peptide (QYDPVAALF)) 0.1 ml total 2.0 ml were injected into one syringe of the syringes 9 coupled to each other through the connector 99.

Here, IFA indicates an incomplete Freund's adjuvant. In addition, the above-mentioned sequence of the peptide is described by one-letter amino acid codes.

The connector 99 was used, which has an inner diameter of 1.0 mm of a flow path having a small diameter, and has a length of 10 mm.

Figure 9:
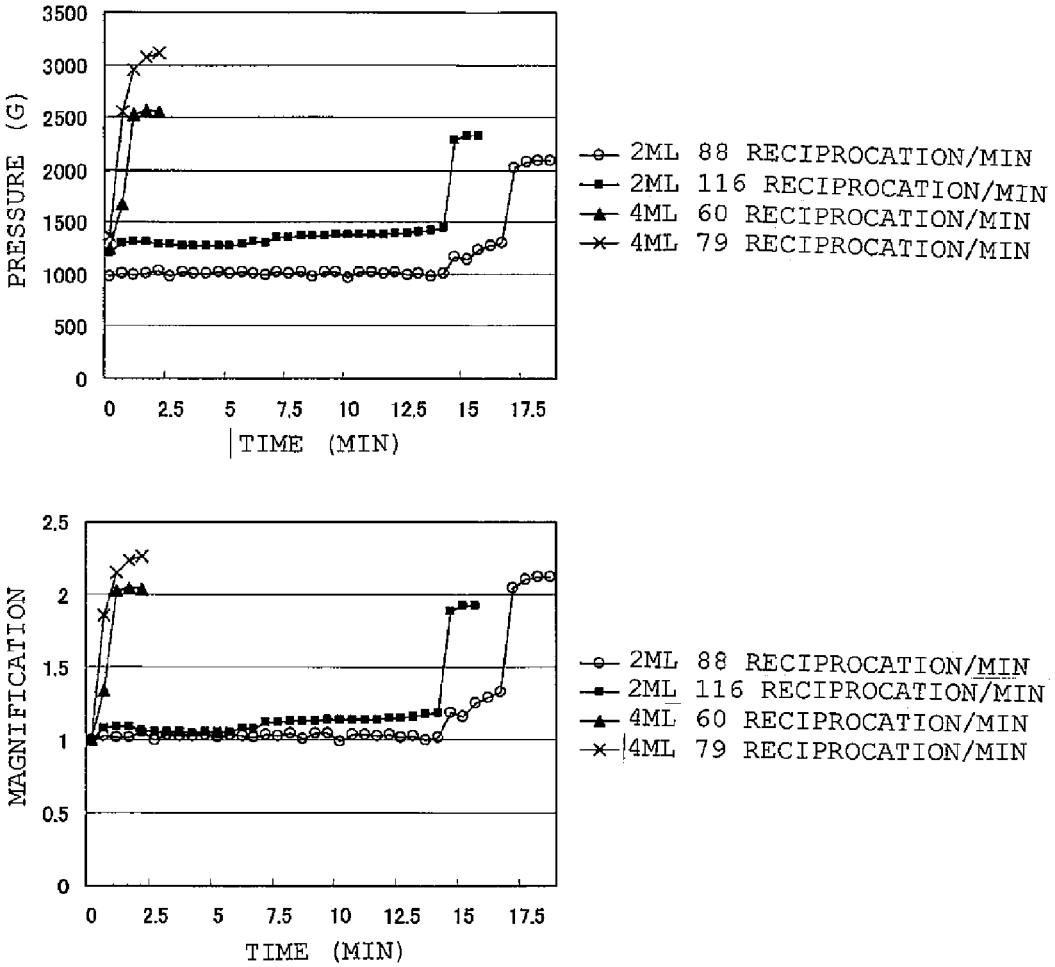
FIG. 9 is graphs showing changes of pressing forces of syringe plungers.

Graphs of FIG. 9 show results of changes of pressing forces of the syringe plungers. According to the results, under a condition that reciprocating movement was 88 reciprocation/min, the pressing pressure increased rapidly after about 17 minutes from the start of agitating. The pressing pressure increased about 2.0 times in average in comparison with the pressing pressure upon the start of agitating, that is, the start of reciprocating movement of the syringe plungers 91. In addition, it was clear that this increase took less than 1 minute of time period and was achieved rapidly within a few seconds. Further, agitating was continued for 1 minute, and then agitating was stopped at the time when the pressing pressure increased about 2.1 times in average.

Meanwhile, under a condition that reciprocating movement was 116 reciprocation/min, the pressing pressure increased rapidly after about 14 minutes from the start of agitating. The pressing pressure increased about 1.9 times in average in comparison with the pressing pressure upon the start of agitating, that is, the start of reciprocating movement of the syringe plungers 91. In addition, it was clear that this increase took less than 1 minute of time period and was achieved rapidly within a few seconds. Further, agitating was continued for 1 minute in a state in which the pressing pressure remained increased about 1.9 times in average, and then agitating was stopped.

Regarding the agitated sample, the completion of the emulsification was evaluated by the drop test method. In the drop test, the nature that, if emulsification is completed to form appropriate emulsion particles, even when the liquid is dropped into water, the liquid is not immediately diffused and retains its spherical shape is set to be an indicator, and the emulsification was evaluated by the following processes (refer to FIG. 10):

1. dropping one drop of the obtained emulsion solution onto water surface; and
2. evaluating that the emulsion is completed, when the emulsion solution is not immediately diffused in the water; or
3. evaluating that the emulsification is not completed, when the emulsion solution is immediately diffused in the water.

Figure 10:
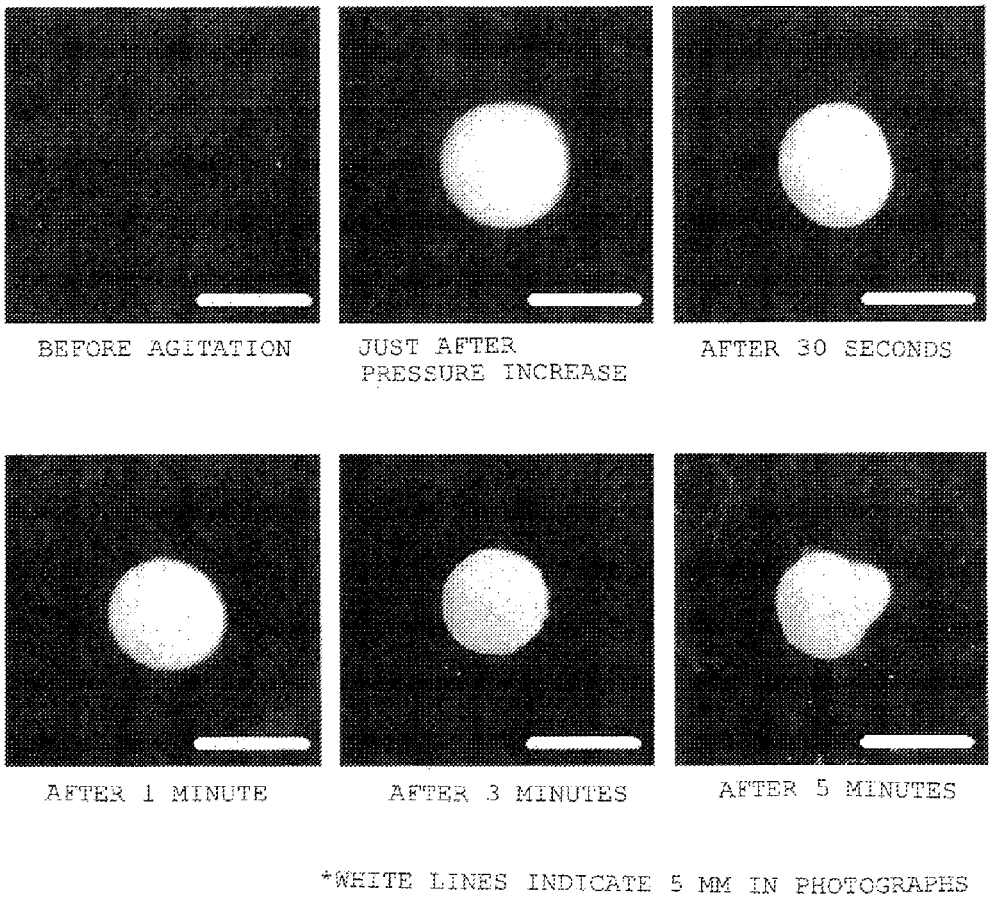
FIG. 10 is photographs of results of drop tests.

As shown in the photographs of FIG. 10, when the emulsion solution of just after the pressing pressure increased rapidly or after 30 seconds after its rapid increase was dropped into water, a partial diffusion was observed and it was evaluated that the emulsification was not completed. However, even when the emulsion solution, agitating of which was continued for 1 minute or more after its rapid increase, was dropped into water, an immediate diffusion was not performed and it could to be evaluated that the emulsion was completed.

Figure 11:
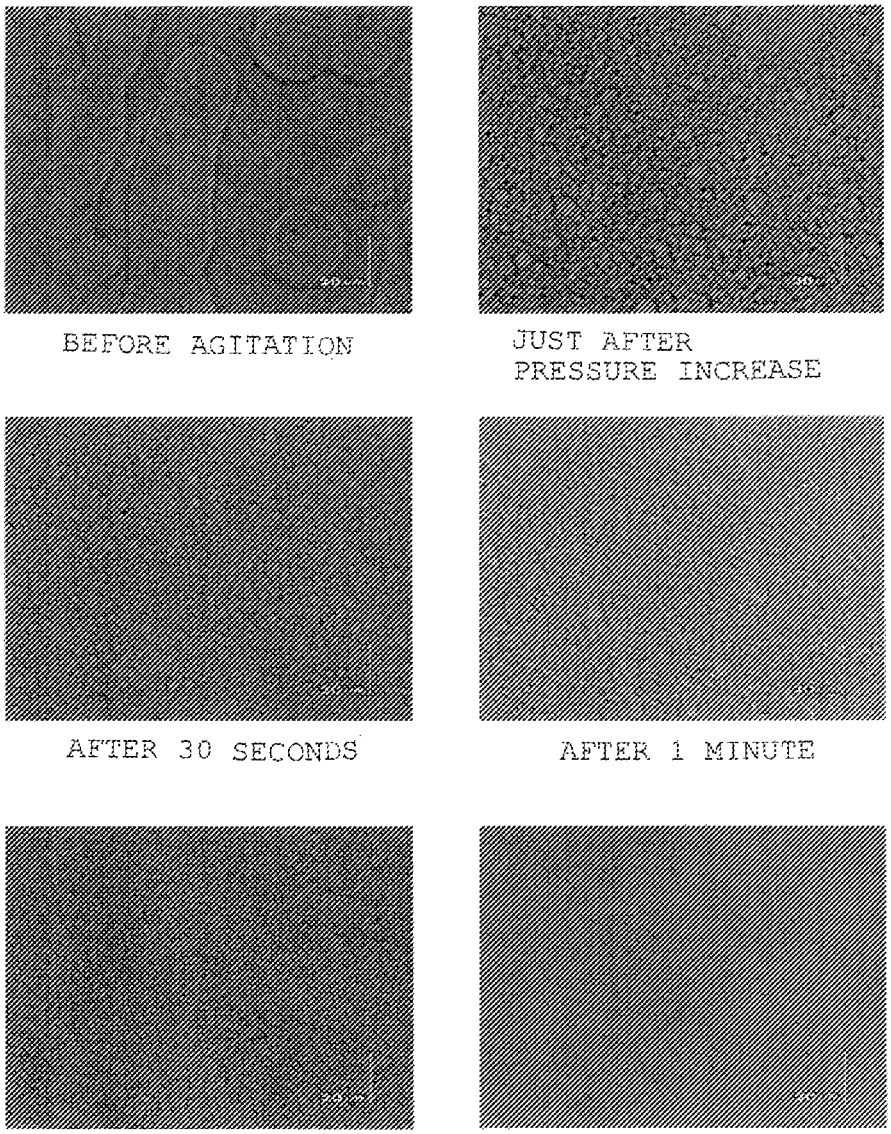
FIG. 11 is microphotographs of emulsion.

In the same manner, regarding the agitated sample, the completion of the emulsification was evaluated by the evenness of the particle sizes. FIG. 11 shows microphotographs of emulsions at each time of agitating. It was confirmed that the particle sizes were not even before the start of agitating, just after the pressing pressure increased rapidly, and after 30 seconds after its rapid increase. It was confirmed that the particle sizes were even after the pressing pressure increased rapidly, after 1 minute, 3 minute, and 5 minute after its rapid increase. Thus the later confirmation could be evaluated as the completion of the emulsion.

As described in the foregoing, under a condition that reciprocating movement was 88 reciprocation/min, it took 1 minute or less, approximately 20 to 40 seconds, for the pressing pressure to increase rapidly and then stop its rapid increase. Thus, it was confirmed that the emulsion may be completed by the following: setting a target value to an arbitrary value between 1,400 g and 2,000 g as the pressing pressure, or to an arbitrary value between 1.4 times and 2.0 times as large as the pressing pressure upon the start, agitating for 1 minute or more after reaching the target value, and then stopping the reciprocating movement of the syringe plungers 91. It is desirable that the target value be larger than the above-mentioned value and the target value be a value which can be reliably reached. Under the above-mentioned condition, the target value may be an arbitrary value between 1,600 g and 1,800 g, or may be an arbitrary value between 1.6 times and 1.8 times as large as the pressing pressure upon the start.

In the same manner, under a condition that reciprocating movement was 116 reciprocation/min, it was confirmed that the emulsion may be completed by the following: setting a target value to an arbitrary value between 1,500 g and 2,300 g as the pressing pressure, or to an arbitrary value between 1.2 times and 1.9 times as large as the pressing pressure upon the start, agitating for 1 minute or more after reaching the target value, and then stopping the reciprocating movement of the syringe plungers 91. It is desirable that the target value be larger than the above-mentioned value and the target value be a value which can be reliably reached. Under the above-mentioned condition, the target value may be an arbitrary value between 1,800 g and 2,000 g, or may be an arbitrary value between 1.4 times and 1.6 times as large as the pressing pressure upon the start.

Example 2

In the above-mentioned syringe pressing apparatus 1 for the production of the emulsion in which the two syringes 9 coupled to each other through the connector 99 were fixed to the casing 10 as illustrated in FIG. 1, a sample was agitated under such a condition that the speed of the reciprocating movement of the syringe plungers 91 was set to 60 reciprocation/min or 79 reciprocation/min.

As a sample for the emulsification, normal saline solution 1.8 ml

IFA 2 ml

DMSO (containing 4 mg of peptide (QYDPVAALF)) 0.2 ml total 4.0 ml were injected into one syringe of the syringes 9 coupled to each other through the connector 99.

Here, IFA indicates an incomplete Freund's adjuvant. In addition, the above-mentioned sequence of the peptide is described by one-letter amino acid codes.

The connector 99 was used, which has an inner diameter of 1.0 mm of a flow path having a small diameter, and has a length of 10 mm.

Graphs of FIG. 9 show results of changes of pressing forces of the syringe plungers. According to the results, under a condition that reciprocating movement was 60 reciprocation/min, the pressing pressure increased rapidly just after the start of agitating. The pressing pressure increased about 2.0 times in average in comparison with the pressing pressure upon the start of agitating, that is, the start of reciprocating movement of the syringe plungers 91. In addition, it was clear that this increase took less than 1 minute of time period and was achieved rapidly within a few seconds. Further, agitating was continued for 1 minute in a state in which the pressing pressure remained increased about 2.0 times in average, and then agitating was stopped.

Meanwhile, under a condition that reciprocating movement was 79 reciprocation/min, the pressing pressure increased rapidly just after the start of agitating. The pressing pressure increased about 2.1 times in average in comparison with the pressing pressure upon the start of agitating, that is, the start of reciprocating movement of the syringe plungers 91. In addition, it was clear that this increase took less than 1 minute of time period and is achieved rapidly within a few seconds. Further, agitating was continued for 1 minute in a state in which the pressing pressure remained increased about 2.2 times in average, and then agitating was stopped.

When, regarding the sample after the stopping of the agitation, the completion of the emulsification was evaluated by the drop test method, it could be evaluated that the emulsion was completed under any of the conditions.

As described in the foregoing, under a condition that reciprocating movement was 60 reciprocation/min, it took 1 minute or less, approximately 20 to 40 seconds, for the pressing pressure to increase rapidly and then stop its rapid increase. Thus, it was confirmed that the emulsion may be completed by the following: setting a target value to an arbitrary value between 1,400 g and 2,500 g as the pressing pressure, or to an arbitrary value between 1.1 times and 2 times as large as the pressing pressure upon the start, agitating for 1 minute or more after reaching the target value, and then stopping the reciprocating movement of the syringe plungers 91. It is desirable that the target value be larger than the above-mentioned value and the target value be a value which can be reliably reached. Under the above-mentioned condition, the target value may be an arbitrary value between 2,000 g and 2,400 g, or may be an arbitrary value between 1.5 times and 1.8 times as large as the pressing pressure upon the start.

In the same manner, under a condition that reciprocating movement was 79 reciprocation/min, it was confirmed that the emulsion may be completed by the following: setting a target value to an arbitrary value between 1,400 g and 2,900 g as the pressing pressure, or to an arbitrary value between 1.1 times and 2.1 times as large as the pressing pressure upon the start, agitating for 1 minute or more after reaching the target value, and then stopping the reciprocating movement of the syringe plungers 91. It is desirable that the target value be larger than the above-mentioned value and the target value be a value which can be reliably reached. Under the above-mentioned condition, the target value may be an arbitrary value between 2,300 g and 2,700 g, or may be an arbitrary value between 1.6 times and 1.9 times as large as the pressing pressure upon the start.

Example 3

In the above-mentioned syringe pressing apparatus 1 for the production of the emulsion in which the two syringes 9 coupled to each other through the connector 99 were fixed to the casing 10 as illustrated in FIG. 1, a sample was agitated under such a condition that the speed of the reciprocating movement of the syringe plungers 91 was set to 88 reciprocation/min.

As a sample for the emulsification, normal saline solution 0.9 ml
IFA 1 ml
DMSO (containing 2 mg of peptide) 0.1 ml
total 2.0 ml were injected into one syringe of the syringes 9 coupled to each other through the connector 99.

Here, IFA indicates an incomplete Freund's adjuvant. In addition, the sequences of the peptides which were used are shown in Table 1.

TABLE 1

| Peptide No. | Sequence |
|---|---|
| No. 1 | RFVPDGNRI |
| No. 2 | KLRQEVKQNL |
| No. 3 | RYCNLEGPPI |
| No. 4 | KTVNELQNL |
| No. 5 | TLFWLLLTL |

The above-mentioned sequences of the peptides shown in Table 1 are described by one-letter amino acid codes.

The connector 99 was used, which has an inner diameter of 1.0 mm of a flow path having a small diameter, and has a length of 10 mm.

Figure 12:
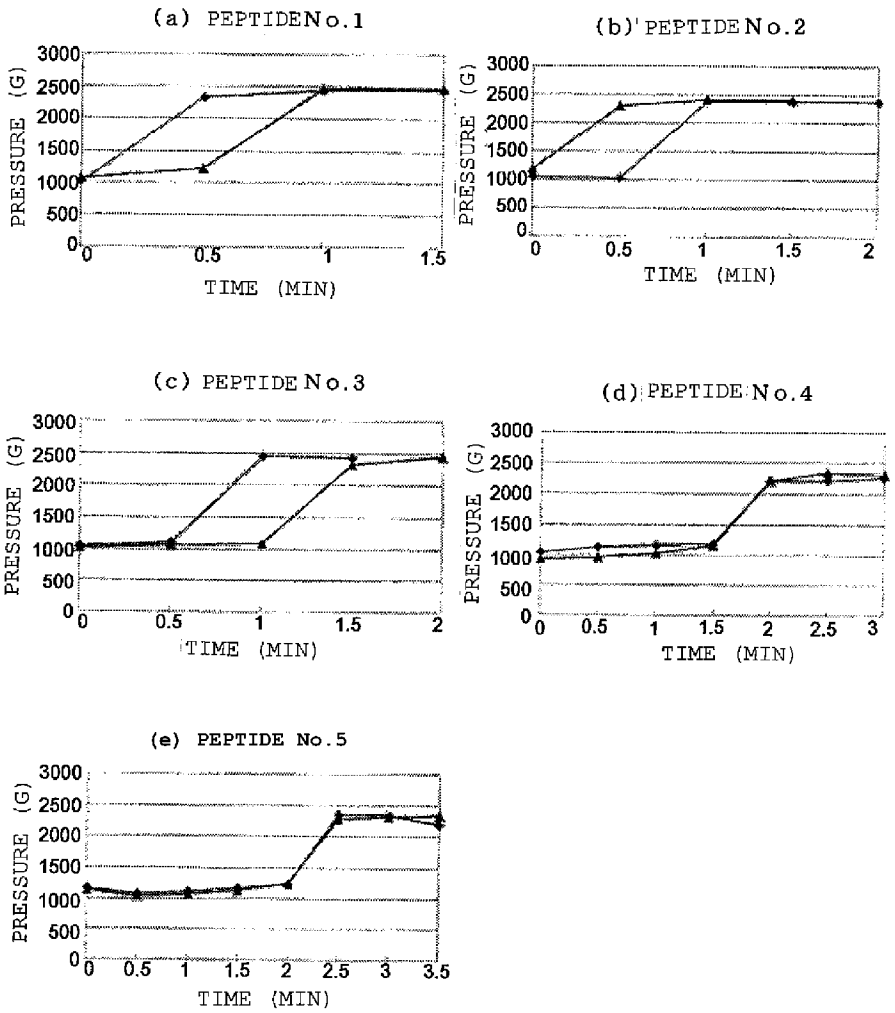
FIGS. 12(*a*) to (*e*) are graphs showing changes of pressing forces of syringe plungers.

FIGS. 12(*a*) to (*e*) shows results of changes of pressing forces of the syringe plungers in each of the peptides No. 1 to No. 5. In FIGS. 12(*a*) to (*e*), the peptide No. 1 indicates (a), the peptide No. 2 indicates (b), the peptide No. 3 indicates (c), the peptide No. 4 indicates (d), the peptide No. 5 indicates (e). As illustrated in FIGS. 12(*a*) to (*e*), the rapid increases of the pressing pressures occurred within 3 minutes after the start of agitating in any of the peptides. These rapid increases of the pressing pressures occurred within 1 minute in all of the peptides. In addition, regarding each of the peptides, the change of the pressing force was measured twice. In any of the peptides, the pressing forces upon the start of agitating and the pressing forces after rapid increase did not have a substantial difference between first-time and second-time measurements.

After confirming the increase of the pressing pressure, agitating was further continued for 1 minute, and then agitating was stopped. When, regarding the agitated sample, the completion of the emulsification was evaluated by the drop test method, it could be evaluated that the emulsion was completed in any of the peptides.

As described in the foregoing, it was confirmed that, irrespective of the kinds of the peptides, the rapid increase of the pressing force occurs. Due to the pressing force of the start of agitating and the pressing force after the rapid increase in each of the peptides, it was confirmed that the emulsion may be completed under a condition that reciprocating movement was 88 reciprocation/min by the following: setting an arbitrary value between 1,200 g and 2,200 g as a target value at which the emulsion in common with these peptides is completed, agitating for appropriately 1 minute after reaching the target value, and then stopping the reciprocating movement of the syringe plungers 91. In addition, also in view of the results of Example 1, under the above-mentioned condition, it was confirmed that it is more desirable that a predetermined value between 1,400 g and 2,000 g be set as the target value which is capable of completing the emulsion irrespective of the kinds of the peptides. Further, it was confirmed that the emulsion may be completed by setting a predetermined value between 2,000 g and 2,500 g depending on the kinds of the peptides, and then stopping the reciprocating movement of the syringe plungers 91 after reaching the target value.

In the preparation of the emulsion, it is possible to prevent the air from being entrained into the cylinders, and hence possible to prepare the emulsion containing no air bubble. In addition, it is possible to use the indicator which is easily detected upon the preparation and which is common among the various kinds of the peptides, and hence possible to easily prepare the homogeneous emulsion. As a result, it is possible to use the syringe pressing apparatus suitably for the preparation of the emulsion.

What is claimed is:

1. A syringe pressing apparatus, comprising:

a syringe fixing mechanism for fixing two syringes to a casing, the two syringes being coupled to each other through a connector; and a pressing mechanism adapted to alternately press syringe plungers of the two syringes a plunger-pressure-measuring device adapted to measure a pressure with which the pressing mechanism presses the syringe plungers; and a control device adapted to control the pressing mechanism correspondingly to the pressure with which the pressing mechanism presses the syringe plungers, the pressure being measured by the plunger-pressure-measuring device.

2. The syringe pressing apparatus according to claim 1, wherein:

the syringe fixing mechanism detachably fixes the two syringes to the casing, the two syringes being coupled to each other through the connector; and the pressing mechanism comprises:

at least one pair of pressing sections adapted to alternately press the syringe plungers of the two syringes;

a driving source adapted to drive the pressing sections; and a power transmission mechanism adapted to transmit a movement of the driving source to the pressing sections so as to cause the pressing sections to linearly and reciprocatingly move.

3. The syringe pressing apparatus according to claim 2, wherein the control device controls the pressing mechanism, when the pressure of pressing the syringe plungers reaches a pressure which is a predetermined multiple of an initial pressure of pressing the syringe plungers or when the pressure of pressing the syringe plungers reaches a predetermined pressing pressure.

4. The syringe pressing apparatus according to claim 3, wherein the control device stops the pressing mechanism, when the pressure of pressing the syringe plungers reaches a pressure which is a predetermined multiple of an initial pressure of pressing the syringe plungers and then a preset time period is passed.

5. The syringe pressing apparatus according to claim 3, wherein the control device stops the pressing mechanism, when the pressure of pressing the syringe plungers reaches a predetermined pressing pressure and then a preset time period is passed.

6. The syringe pressing apparatus according to claim 3, wherein the predetermined pressing pressure is an increased pressure from an initial pressure of pressing the syringe plungers.

7. The syringe pressing apparatus according to claim 3, further comprising a cooling device adapted to cool the driving source.

8. The syringe pressing apparatus according to claim 7, further comprising a timer adapted to manage a driving time period of the pressing mechanism.

9. The syringe pressing apparatus according to claim 8, further comprising a pressure-informing mechanism adapted to inform that the pressure of pressing the syringe plungers reaches a predetermined pressure, the pressure being measured by the plunger-pressure-measuring device.

10. The syringe pressing apparatus according to claim 9, further comprising a stopping-informing mechanism adapted to inform of stopping of the pressing mechanism.

11. The syringe pressing apparatus according to claim 10, wherein each of the pressing sections is provided with an adjusting member adapted to adjust a distance between each of the pressing sections and each of the syringe plungers.

12. The syringe pressing apparatus according to claim 11, wherein the syringe pressing apparatus is a syringe pressing apparatus for emulsion production, adapted to produce an emulsion by agitating a raw material of the emulsion in the syringes.

13. The syringe pressing apparatus according to claim 11, wherein the syringe pressing apparatus is a pressing force-measuring apparatus for the syringe plungers, adapted to measure a pressure with which the syringe plungers press an object injected into the syringes.

14. The syringe pressing apparatus according to claim 1, further comprising a plunger-pressure-measuring device adapted to measure a pressure with which the pressing mechanism presses the syringe plungers.

15. The syringe pressing apparatus according to claim 14, further comprising a control device for controlling the pressing mechanism correspondingly to the pressure with which the pressing mechanism presses the syringe plungers, the pressure being measured by the plunger-pressure-measuring device.

16. The syringe pressing apparatus according to claim 15, wherein the syringe pressing apparatus is a syringe pressing apparatus for emulsion production, adapted to produce an emulsion by agitating a raw material of the emulsion in the syringes.

17. A method of producing an emulsion, comprising:

installing two syringes, into which a raw material of the emulsion is injected, and which are coupled to each other through a connector, in the syringe pressing apparatus according to claim 16;

causing the raw material of the emulsion to move between the syringes via the connector so as to be agitated by alternately pressing syringe plungers, and consequently the emulsion is prepared.

18. A method of evaluating completion of an emulsion, comprising:

installing two syringes, into which a raw material of the emulsion is injected and which are coupled to each other through a connector, in the syringe pressing apparatus according to claim 16;

causing the raw material of the emulsion to move between the syringes via the connector so as to be agitated by alternately pressing syringe plungers and measuring a pressure of pressing the syringe plungers; and informing that the measured pressure reaches a predetermined pressure.

19. A method of producing an emulsion, comprising:

installing two syringes, into which a raw material of the emulsion is injected and which are coupled to each other through a connector, in the syringe pressing apparatus according to claim 12;

causing the raw material of the emulsion to move between the syringes via the connector so as to be agitated by alternately pressing syringe plungers;

measuring a pressure of pressing the syringe plungers; and controlling a pressing pressure of the syringe plungers correspondingly to the measured pressure, and consequently the emulsion is prepared.

20. The method of producing an emulsion according to claim 19, wherein the pressing mechanism is stopped when the pressure of pressing the syringe plungers reaches a pressure which is a predetermined multiple of an initial pressure of pressing the syringe plungers and then a preset time period is passed.

21. The method of producing an emulsion according to claim 19, wherein the pressing mechanism is stopped when the pressure of pressing the syringe plungers reaches a predetermined pressing pressure and then a preset time period is passed.

22. The method of producing an emulsion according to claim 21, wherein the predetermined pressing pressure is an increased pressure from an initial pressure of pressing the syringe plungers.

23. A method of evaluating completion of an emulsion, comprising:

installing two syringes, into which a raw material of the emulsion is injected, and which are coupled to each other through a connector, in the syringe pressing apparatus according to claim 12;

causing the raw material of the emulsion to move between the syringes via the connector so as to be agitated by alternately pressing syringe plungers and measuring a pressure of pressing the syringe plungers; and informing that the measured pressure reaches a predetermined pressure.

* * * * *